US006394572B1

(12) United States Patent
Pierce et al.

(10) Patent No.: US 6,394,572 B1
(45) Date of Patent: May 28, 2002

(54) DYNAMIC CONTROL OF PRINTHEAD TEMPERATURE

(75) Inventors: Mathew W. Pierce, Otis Orchards; James M. Brenner, Vancouver, both of WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/468,699

(22) Filed: Dec. 21, 1999

(51) Int. Cl.[7] ..... B41J 2/375
(52) U.S. Cl. ..... 347/17; 347/194
(58) Field of Search ..... 347/17, 194

(56) References Cited

U.S. PATENT DOCUMENTS

| | | | |
|---|---|---|---|
| 4,910,528 | A | 3/1990 | Firl et al. |
| 5,168,284 | A | 12/1992 | Yeung |
| 5,475,405 | A | 12/1995 | Widder et al. |
| 5,527,121 | A | 6/1996 | Santon |
| 5,627,947 | A | 5/1997 | Chan et al. |
| 5,633,671 | A | 5/1997 | Watanabe |
| 5,646,655 | A | 7/1997 | Iwasaki et al. |
| 5,669,721 | A | 9/1997 | Santon et al. |
| 5,673,069 | A | 9/1997 | Canfield et al. |
| 5,699,090 | A | 12/1997 | Wade et al. |
| 5,736,995 | A | 4/1998 | Bohorquez et al. |
| 5,745,130 | A | 4/1998 | Becerra et al. |
| 5,751,304 | A | 5/1998 | Hirabayashi et al. |
| 5,812,156 | A | 9/1998 | Bullock et al. |
| 5,861,895 | A | 1/1999 | Tajika et al. |
| 5,880,753 | A | 3/1999 | Ikeda et al. |
| 5,881,451 | A | 3/1999 | Kneezel et al. |
| 5,923,344 | A | 7/1999 | Norum et al. |
| 5,940,094 | A | 8/1999 | Otsuka et al. |

FOREIGN PATENT DOCUMENTS

| | | |
|---|---|---|
| JP | 11-58808 | * 3/1999 |
| JP | 2000-295447 | * 10/2000 |

* cited by examiner

*Primary Examiner*—Huan Tran

(57) ABSTRACT

Printhead operating temperature control by sampling of the printhead's temperature in combination with an algorithm for estimating whether the printhead will exceed its maximum operating temperature during a scan across the media. If the estimation shows that the maximum operating temperature will be exceeded, the printing operation is halted (not aborted) at a convenient location in the scan. The unprinted data of that scan is preserved in memory, and the printhead is allowed to cool. The printhead is returned to the beginning of the scan during which the printing was halted, the scan is restarted, and the printhead is controlled to recommence firing ink drops at the location where the firing had been stopped in the previous scan. The technique for estimating whether the printhead maximum operating temperature may be exceeded takes into account factors (such as the distance to the end of the scan) that, in combination with in-scan temperature sensing, enables the operation of the printhead at a temperature very close to its maximum operating temperature, without exceeding that temperature.

19 Claims, 5 Drawing Sheets

DYNAMIC CONTROL OF PRINTHEAD TEMPERATURE

TECHNICAL FIELD

This invention relates to methods and apparatus for dynamically controlling the temperature of an ink-jet printhead.

BACKGROUND AND SUMMARY OF THE INVENTION

An ink-jet printer includes at least one print cartridge that contains ink within a reservoir. The reservoir is connected to a printhead that is mounted to the body of the cartridge. The printhead is controlled for ejecting minute drops of ink from the printhead to a sheet of print medium, such as paper, that is advanced through the printer.

Many ink-jet printers include a carriage for holding the print cartridge. The carriage is scanned across the width of the paper, and the ejection of the drops onto the paper is controlled to form a swath of an image with each scan. Between carriage scans, the paper is advanced so that the next swath of the image may be printed. Sometimes, more than one swath is printed before the paper is advanced.

The printheads of modern ink-jet printers are capable of high-speed, high-resolution printing. Heat from the printhead firing resistors is transferred to the other printhead components. Also, the data carrying the information to be printed may be quite dense in instances where, for example, high-resolution color images are to be printed. As a consequence, printing tasks specifying high print density (that is, requiring relatively high numbers of ink drops over a unit area) can cause the operating temperature of the printhead to approach the maximum operating temperature of the printhead.

The maximum operating temperature of the printhead is established to ensure that the printhead is not operated at a temperature level that might cause the printhead to fail or otherwise diminish print quality. In this regard, it is possible to operate some printheads at a temperature level above the state transition temperature of some of the printhead components. Such operation would lead to complete failure of the printhead.

One past approach to controlling the printhead temperature involved the steps of examining the print density of a particular print job using thermal potential modeling. This modeling is reflects an empirically derived relationship between various print densities and associated thermal characteristics. The modeling reveals how hot the printhead may become for given print densities. In instances where the thermal potential model shows that the printhead maximum operating temperature would be exceeded, steps were taken to operate the printhead at a lower temperature. Such steps included slowing the printing operation by using more scans to print one swath, or by introducing cooling delays in the printhead operation upon the completion of each scan. Examining print data for thermal potential modeling is expensive in terms of system memory and processing.

Many past approaches to sensing printhead temperature feature sensors that can not be read with sufficient frequency to enable true dynamic temperature control of the printhead. As a result, the printheads were, typically, conservatively operated at temperatures significantly below their maximum operating temperature. Such conservative operation thus introduced unneeded delay in printing (such as unnecessarily long post-scan cooling delays) to ensure that the printhead did not exceed its maximum operating temperature.

The present invention is generally directed to a dynamic approach to controlling printhead temperature. The control is available during individual scans of the printhead across the media. Thermal potential modeling is not required in the method undertaken in the present invention. As a result, the processing and memory costs associated with thermal potential modeling is avoided.

The present invention incorporates high-frequency sampling of the printhead's temperature in combination with a technique for estimating whether the printhead will exceed its maximum operating temperature during a scan across the media. If the estimation shows that the maximum operating temperature will be exceeded, the printing operation is halted (not aborted) at a convenient location in the scan. The unprinted data of that scan is preserved in memory, and the printhead is allowed to cool. The carriage (hence the printhead) is returned to the beginning of the scan during which the printing was halted (the paper is not advanced in the interim), the scan is restarted, and the printhead is controlled to recommence firing ink drops at the location in the scan where the firing had been stopped.

The firmware module that is responsible for delivering the firing signals to the printhead controls the stopping and restarting of the printhead firing. The printhead firing is stopped at a convenient location in the stream of print data, such as between byte or word boundaries in the data. As a result, the printing operation can be recommenced at the precise location it was stopped, thereby avoiding print defects that might otherwise occur if the mid-scan stopping and starting of the printhead were not so controlled.

As another aspect of this invention, the technique for estimating whether the printhead maximum operating temperature may be exceeded takes into account factors (such as the distance to the end of the scan) that, in combination with high-frequency temperature sensing, enables the operation of the printhead at a temperature very close to its maximum operating temperature, without exceeding that temperature. Other advantages and features of the present invention will become clear upon review of the following portions of this specification and the drawings.

DETAILED DESCRIPTION OF PREFERRED EMBODIMENTS

Figure 1:
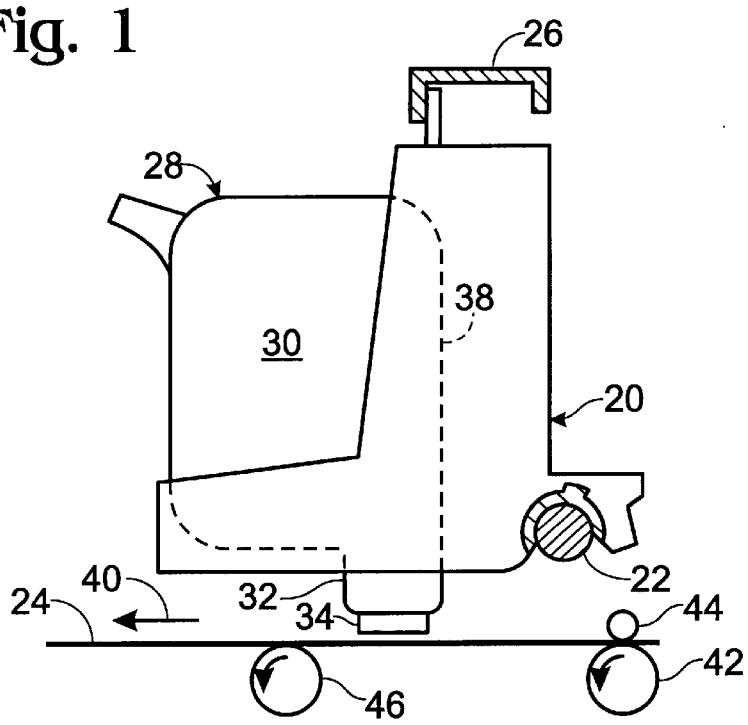
FIG. 1 is a side view diagram of carriage and print cartridge components of an ink-jet printer of the general type to which the present invention may be adapted

FIG. 1 depicts conventional carriage and print cartridge components of an ink-jet printer for which the present invention may be adapted. It will be appreciated, however, that the present invention may be used with a wide variety of such printers. The system depicted in FIG. 1 includes a carriage 20 that is slidable along a support rod 22 that is housed within an inkjet printer. The rod 22 extends across the printer, oriented perpendicularly to the direction that the print media (such as paper 24) is incrementally advanced through the printer. The upper portion of the carriage bears against a stationary part of the printer designated as a guide rail 26.

One or more inkjet cartridges 28 are removably mounted to the carriage. In the illustrated embodiment, only one cartridge 28 is depicted. The cartridge 28 includes a plastic body that comprises a liquid-ink reservoir 30. The cartridge body is shaped to have a downwardly depending snout 32. A printhead 34 (the size of which is greatly enlarged in the drawing) is attached to the end of the snout. The printhead includes an outer surface in which is defined nozzles. Minute ink drops are expelled through the nozzles onto the paper 24.

In a typical printhead 34, the nozzles reside in a plate that covers most of the printhead. The plate is bonded to an ink barrier layer of the printhead. This barrier layer is laminated onto a substrate and is shaped to define ink chambers. The chambers have one or more channels that connect the chambers with the reservoir of ink. Each chamber is continuous with one of the nozzles from which the ink drops are expelled.

The ink drops are expelled from each ink chamber by a heat transducer, such as a thin-film resistor. The resistor is carried on the printhead substrate, which is preferably a conventional silicon wafer upon which has been grown an insulation layer, such as silicon dioxide. The resistor is covered with suitable passivation and other layers, as is known in the art.

To expel or "fire" an ink drop, a printhead resistor is driven (heated) with a control signal that comprises a pulse of electrical current. The heat from the resistor is sufficient to form a vapor bubble in the surrounding ink chamber. The rapid expansion of the bubble instantaneously forces a drop through the associated nozzle. The chamber is refilled after each drop ejection with ink that flows into the chamber through the channel(s) that connects with the ink reservoir.

The ink cartridge 28 has a circuit mounted on an outer surface 38 of the reservoir 30. The circuit includes exposed contacts that mate with contacts of a circuit carried inside the carriage 20. The carriage is connected, as by a flexible, ribbon-type multi-conductor to the printer controller. Among other things, the printer controller provides to the cartridge the control signals for precisely timed firing of ink drops. As noted, the drops render text or images on the advancing paper as the carriage (hence, the printhead) is scanned across the printer (i.e., into and out of the plane of FIG. 1). FIG. 1 also illustrates in somewhat simplified fashion a typical way of moving paper 24 through the printer. Each cartridge 28 is supported above the paper 24 by the carriage 20 such that printhead 34 is maintained at a desired spacing relative to the paper. The space where the printhead is near the paper can be called the print zone. The paper 24 is picked from an input tray and driven into the print zone in the direction of arrow 40. To this end, the leading edge of the paper may be fed into the nip between a drive roller 42 and an idler or pinch roller 44 and is driven in a controlled manner through the print zone, from where the leading edge encounters an output roller 46, and then advances into an output tray.

As noted earlier, the printheads of modern ink-jet printers are capable of high-speed, high-resolution printing. Printing tasks specifying high print density can cause the operating temperature of the printhead to approach the maximum operating temperature of the printhead.

The present invention is directed to a way of dynamically controlling the printhead temperature. The description of this approach begins with reference to FIG. 2, which is a graph showing the temperature profile of an ink-jet printhead, operated in accordance with the present invention, as the printhead is scanned across the print media.

Figure 2:
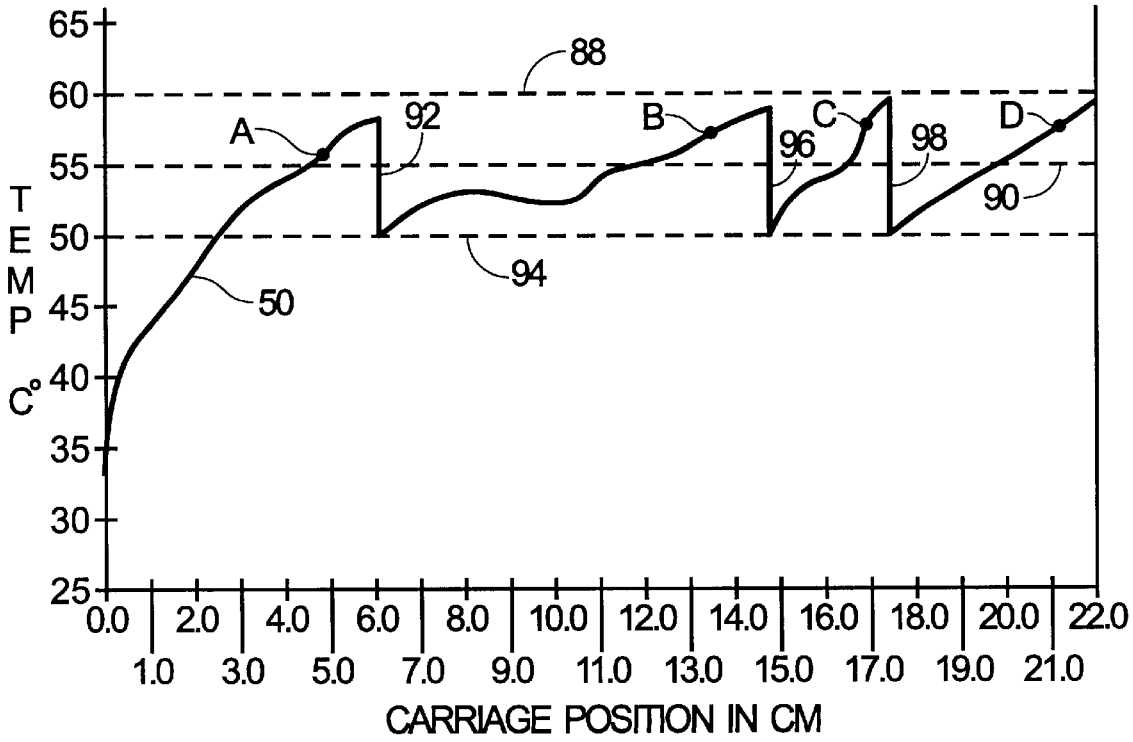
FIG. 2 is a graph showing a temperature profile of an ink-jet printhead that is operated in accordance with the present invention as the printhead is scanned across print media.

The abscissa of the graph in FIG. 2 represents the position of the carriage 20 as it is moved across the print media (the print media hereafter simply referred to as paper, although any media type may be used). In this graph, the units of carriage position are provided in terms of length (centimeters). The left edge of the abscissa marks the start position of the carriage, which is very close to the edge of the paper. Thus, in this embodiment the carriage scans from left to right and carries the print cartridge and its printhead with it. The average time for the carriage to complete one trip across the printer is about 500 msec.

The ordinate of the graph of FIG. 2 is in units of temperature, as shown. The line 50 plotted in the graph represents an example of a temperature profile of a printhead as it is scanned across the paper but controlled so that it does not exceed the maximum operating temperature of the printhead (in this example 60° C.). The particulars of the temperature profile are described more below in conjunction with the following description of a preferred printer system for implementing the approach of the present invention.

Figure 3:
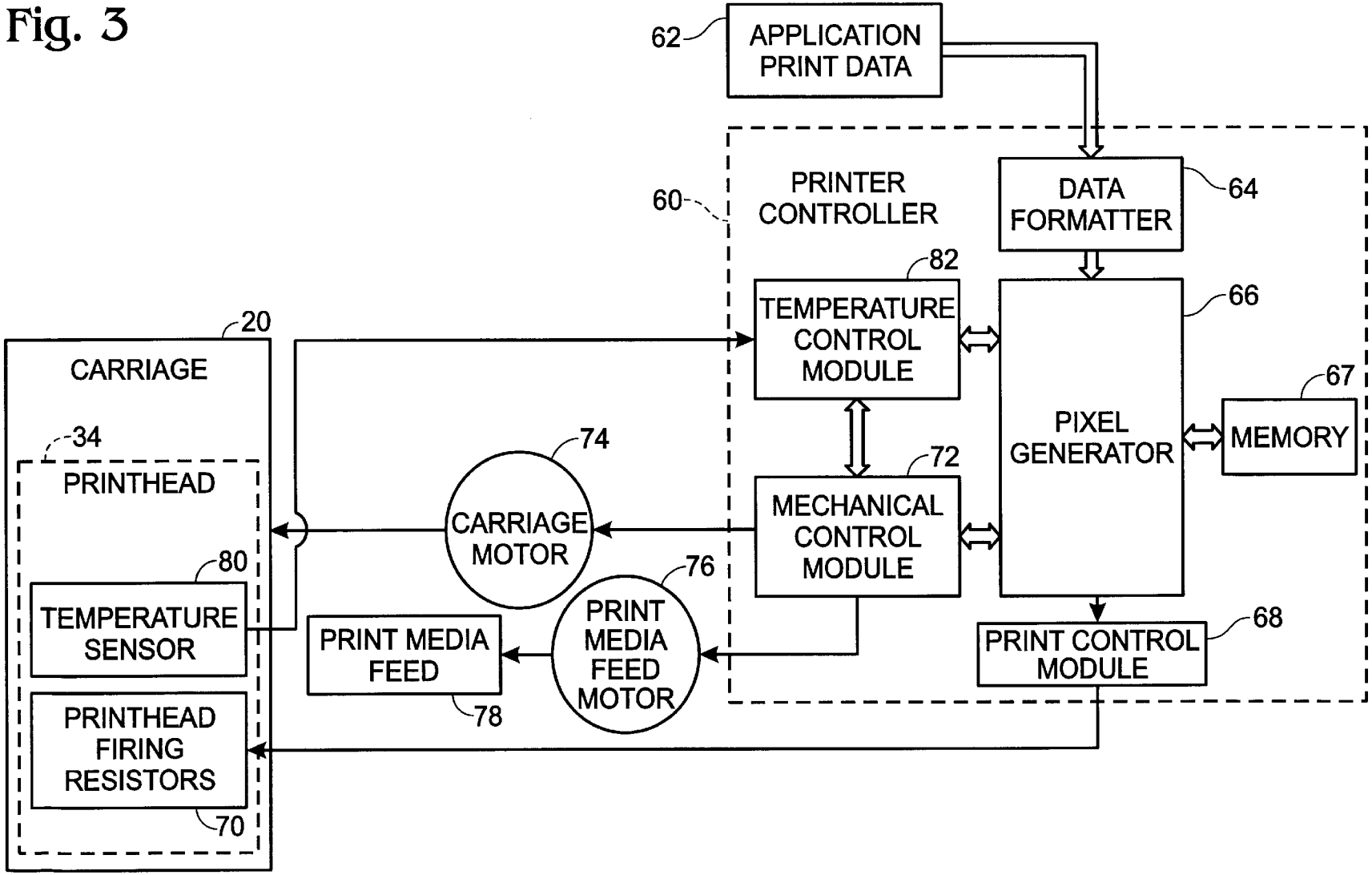
FIG. 3 is a block diagram of a preferred system for carrying out the dynamic temperature control of the present invention.

FIG. 3 is a block diagram of a printer system configured and operated in accord with the present invention. The printer controller 60 is provided with application print data 62 that, in conventional fashion, describes the page to be printed and carries printer command language.

The data formatter 64 of the printer controller 60 translates the application print data to provide to a pixel generator module 66 printer-specific rows of raster data. The pixel generator 66 converts the rows of raster data into columns of pen-firing data that conform to the columns of nozzles in the printhead and to the precise location in the scan where ink drops are to be fired by the printhead.

The pen firing data is fed to a printer control module 68 that provides control signals in the form of current pulses to the printhead firing resistors 70. These signals may be provided by direct or multiplex addressing.

The printer controller 60 also includes a mechanical control module 72 for controlling movement of the paper and the carriage as required by the application print data. In this regard, the mechanical control module 72 drives in conventional fashion a carriage motor 74 that is linked to the carriage (as by a toothed, endless belt) for scanning the carriage across the paper.

The mechanical control module 72 also drives a motor 76 for actuating a conventional print media feed mechanism 78 that incrementally advances the paper through the printer between scans, as described above.

In accordance with a preferred embodiment of the present invention, the temperature of the printhead is frequently sensed by a temperature sensor 80 that is mounted to the printhead. In one embodiment, the sensor comprises a thermistor that is incorporated on the printhead substrate with suitable amplification and analog to digital conversion (also present on the printhead substrate) for providing digital signals (representative of the instantaneous printhead temperature) to a temperature control module 82 of the print controller.

It will be appreciated that any of a number of other mechanisms can be used for temperature sensing on the printhead. For instance, the printhead could be equipped with a temperature-controlled oscillator the produces a train of rectangular, digital output pulses having a temperature dependent frequency.

The temperature control module 82 frequently samples the printhead temperature while the printhead is scanned across the media. In this regard, the term "scan" when used here as a noun is intended to refer to the distance the printhead traverses from one side of the media to another to print a single swath. In one example, a scan may be completed in 500 msec. The temperature control module 82 preferably samples the printhead temperature about 15 times during the scan (about every 30 msec). These temperature-sampling events are referred to as thermal checkpoints.

At the thermal checkpoints, the temperature control module 82 computes the running average of the sensed printhead temperature. For illustration, it is this running average that is depicted as the printhead thermal profile 50 in FIG. 2. Location "A" in FIG. 2 is an example of a thermal checkpoint. It can be appreciated that, upon study of the slope of the line 50 up to (to the left of) thermal checkpoint "A" that the forward extrapolation of the printhead temperature profile shows it will exceed the maximum operating temperature 88 of the printhead, which, in this example is 60° C. unless the printhead is cooled.

Put another way, the estimation that the printhead is tending to overheat is carried out in the temperature control module 82 of the printer controller 60 by a straightforward algorithm that extrapolates the curve based upon the slope of the temperature profile 50 (as quantified by the running average temperature data). If the estimation reveals that the printhead maximum operating temperature will be exceeded, steps are taken to cool the printhead.

The primary step undertaken to cool the printhead is to temporarily halt printing. To that end, however, the system operating in accord with the present invention first identifies boundaries within the scan that are best for halting printing in a manner such that the printing can later be resumed (after the printhead has cooled) with little or no reduction in print quality. In the preferred embodiment, these boundaries are selected to be where the print data can be neatly separated, between bytes or words of that data.

Thus, as part of the present invention, the pixel generator module 66 identifies and makes available to the temperature control module 82 boundaries (hereafter called stopping points) that are present in the stream of firing data that is to be applied to the printhead resistors 70 for the present scan. The pixel generator screens the firing data to identify the locations of the boundaries, which locations are stored in the memory 67 of the printer controller 60.

The conditions required for the temperature control module 82 to initiate a temporary halt to printing are: (1) the slope of the printhead temperature profile indicates that the maximum operating temperature 88 will be exceed before the scan is complete; and (2) the running average temperature 50 of the printhead has exceeded a threshold temperature.

The threshold temperature 90, which in this example is 55° C., is selected to be the level that must be exceeded before cooling steps are undertaken. That is, irrespective of the print density of the firing data for the scan, the threshold temperature can be selected so that even though the printhead temperature is increasing at a rate such that the maximum operating temperature 88 apparently will be exceeded, the printhead temperature can be allowed to climb to the threshold temperature because a location for cooling the printhead will be reached before the maximum operating temperature is reached.

The threshold level 90 thus may be predetermined for a particular printhead type and saved in the printer controller firmware (such as the read-only-memory (ROM) that stores the various controller modules discussed above). Alternatively, however, the threshold temperature level is dynamically established for each scan. As discussed above, the print data for each scan is previewed by the pixel generator 66 to identify possible stopping points in the scan that can be used to halt printing to allow the printhead to cool. The number of these stopping points for each scan will vary from scan to scan because the print data varies depending on what is to be printed. Thus, when a stream of firing data for a particular scan has several stopping points, the threshold temperature 90 can be nearer to the maximum operating temperature 88 since once the threshold temperature is exceeded, one of the printhead-cooling stopping points will be nearby so that the printing can be soon halted and the printhead cooled.

On the contrary, if the print data to the pixel generator provides few stopping points, the threshold temperature 90 should be lowered because once that threshold is exceeded, the printhead will need to continue firing for a significant time (hence, further heating the printhead) until the stopping point is reached.

When a dynamically selected threshold temperature is used, a number of such temperatures may be empirically derived in advance (for a given printhead type, for instance) and saved in memory as entries in a look-up table, each temperature associated with, for example, a range of stopping points. Thus, for a given number of stopping points identified in the pixel generator for a given scan, resort is made by the temperature control module 82 to the look-up table to determine the appropriate threshold temperature 90. Many stopping points would permit use of a relatively high threshold temperature. Few stopping points would require a relatively lower threshold temperature.

The selection of an appropriate threshold temperature may be a function of other factors in addition to (or in lieu of) the number of stopping points in a scan. For example, the sensitivity of the temperature sensor or other system attributes can be considered in establishing the threshold temperature. In any event, it is noteworthy that the just-described estimation technique carried out by the temperature control module 82 in considering the threshold temperature condition, as just described, enables the printhead to be operated at a temperature that is very close to its maximum operating temperature, without exceeding that maximum temperature.

As noted, two conditions for stopping printing need be present: (1) the slope of the printhead temperature profile indicates that the maximum operating temperature 88 will be exceed before the scan is complete; and (2) the running average temperature 50 of the printhead exceeds a threshold temperature 90. In the example of FIG. 2, this occurs at checkpoint "A." Thus, the printhead will continue to print until it reaches the next stopping point, which appears at 92 in FIG. 2. In this regard, the pixel generator 66 monitors the status of the mechanical control module 72, via the print control module 68, halts the firing data (current pulses) sent to the printhead resistors at that next stopping point 92. Coincidentally, the data corresponding to the firing data between the stopping point and the end of the scan is saved in memory 67.

Although printing is halted at the stopping point, the carriage continues to move to the end of the scan and is then returned to the beginning of that same scan. The mechanical control module 72, which is flagged by the temperature control module to indicate that cooling steps are undertaken, prevents the print media feed from advancing the paper in the interim.

Preferably, printing does not recommence until the printhead temperature reaches a cooling temperature level. In this example, that cooling level 94 is selected to be 50° C. (FIG. 2). For the sake of illustration, the temperature profile depicted in FIG. 2 is controlled within a somewhat narrow range (50–60° C.). Considerably wider temperature ranges are contemplated, however, as well as narrower ones.

Once the cooling temperature 94 is reached, the carriage is scanned across the media and, when the pixel generator 66 (monitoring the status of mechanical control module 72) determines that the stopping point is reached, the print control module 68 recommences firing of the printhead resistors to complete printing of the scan.

The temperature profile 50 of the example in FIG. 2 illustrates stopping points 96 and 98 where printing is again stopped and the printhead cooled after the two above-described conditions were met at respective thermal checkpoints "B" and "C." It is noteworthy that at checkpoint "D," although one condition is met (the running average of the printhead temperature being above the threshold temperature 90), the other condition is not. That is, at "D" the slope of the temperature profile is such that the printhead will reach the end of the scan (and, thus, cool between scans) before the maximum operating temperature 88 is reached. Thus, one will appreciate that the estimation of temperature made in the temperature control module takes into account the edges of the print media.

With reference to FIG. 2, it may be useful to point out that at the start of a scan, an otherwise idle printhead is rapidly heated to a minimum operating temperature. Such heating or pre-heating to the minimum temperature may be accomplished by, for example, providing current pulses to the printhead resistors that are sufficient to heat the printhead but insufficient to expel ink droplets.

Figure 4:
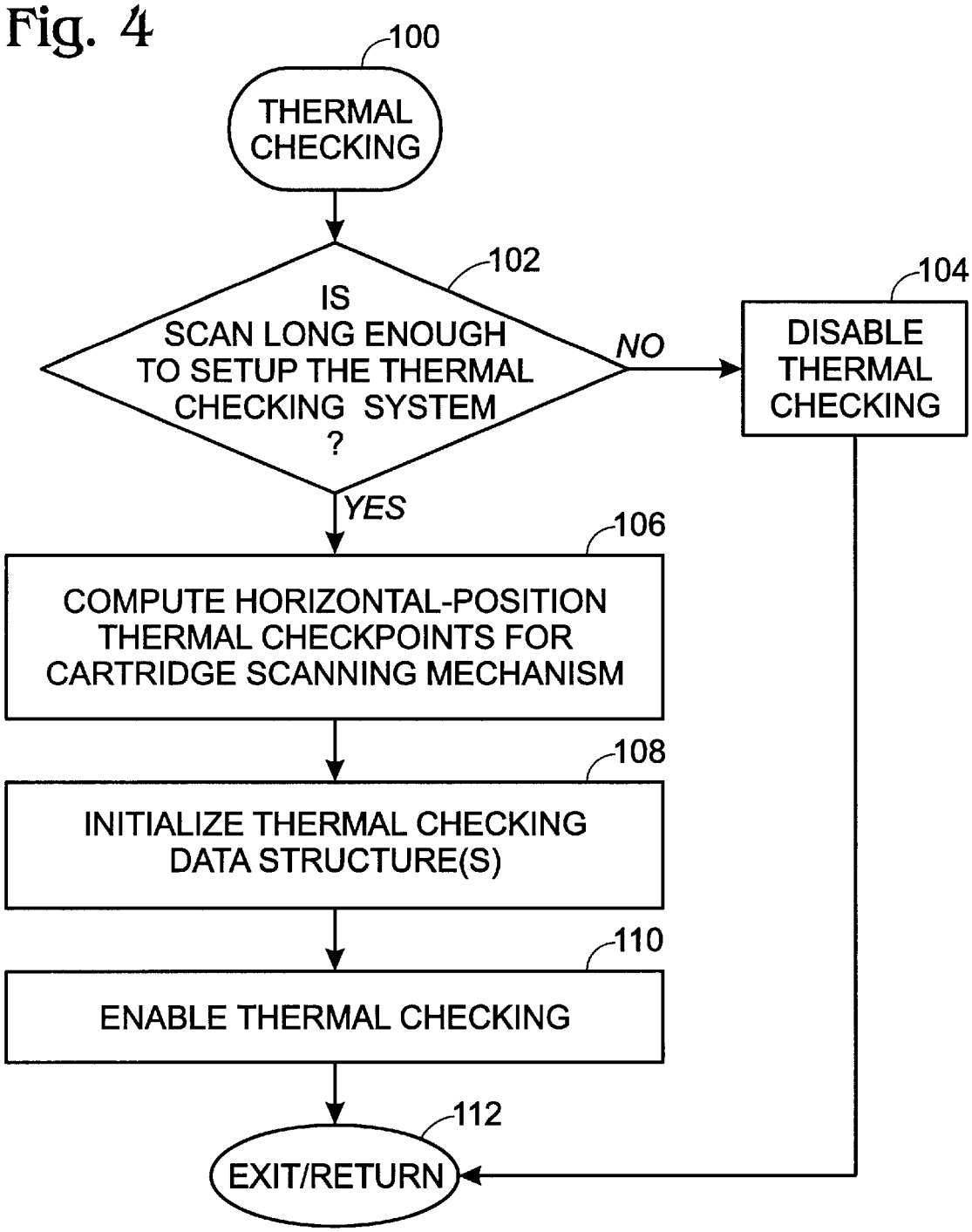
FIGS. 4–6 are flow diagrams describing steps undertaken in carrying out the dynamic temperature control of the present invention.
Figure 5:
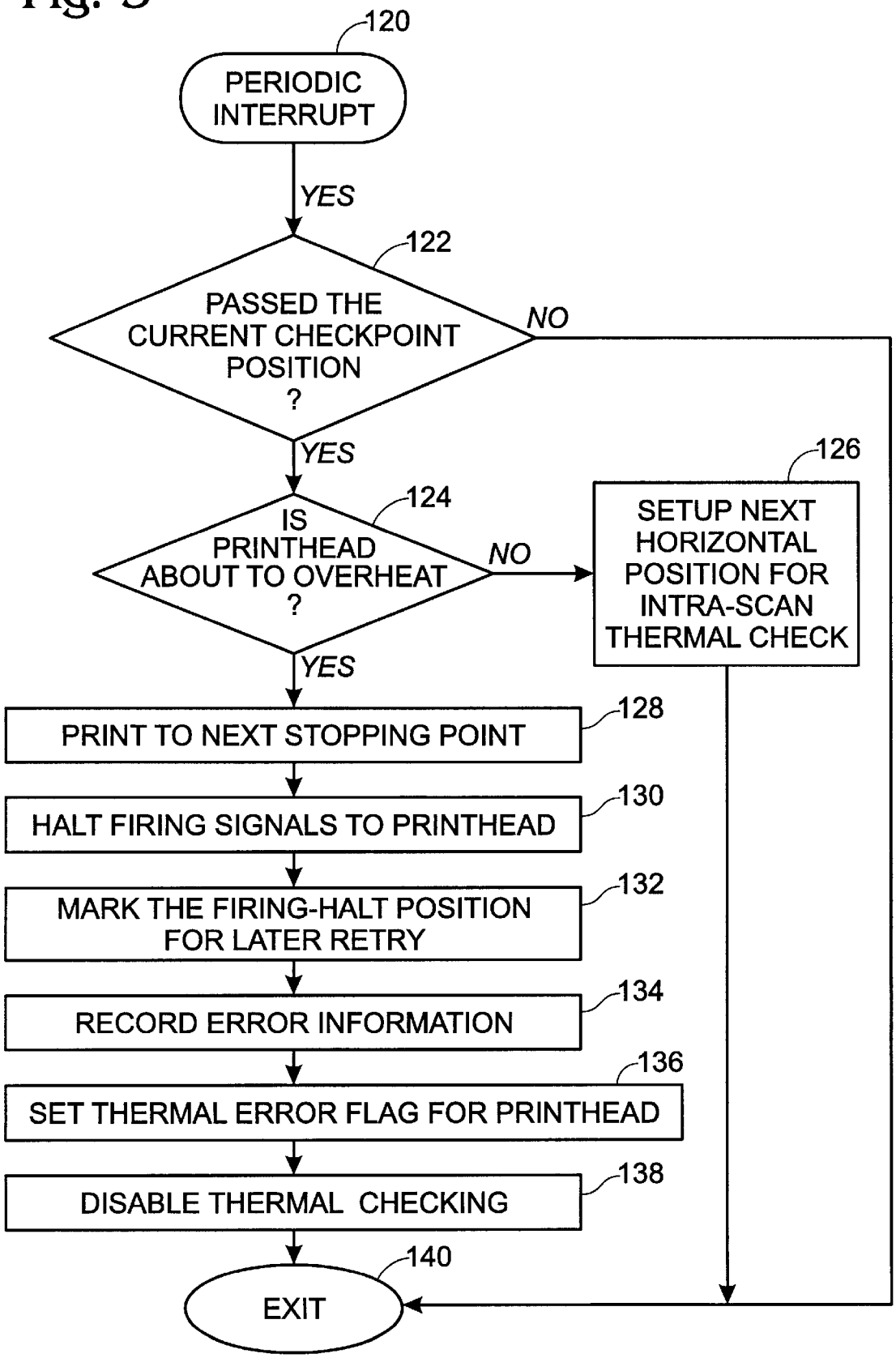
Figure 6:
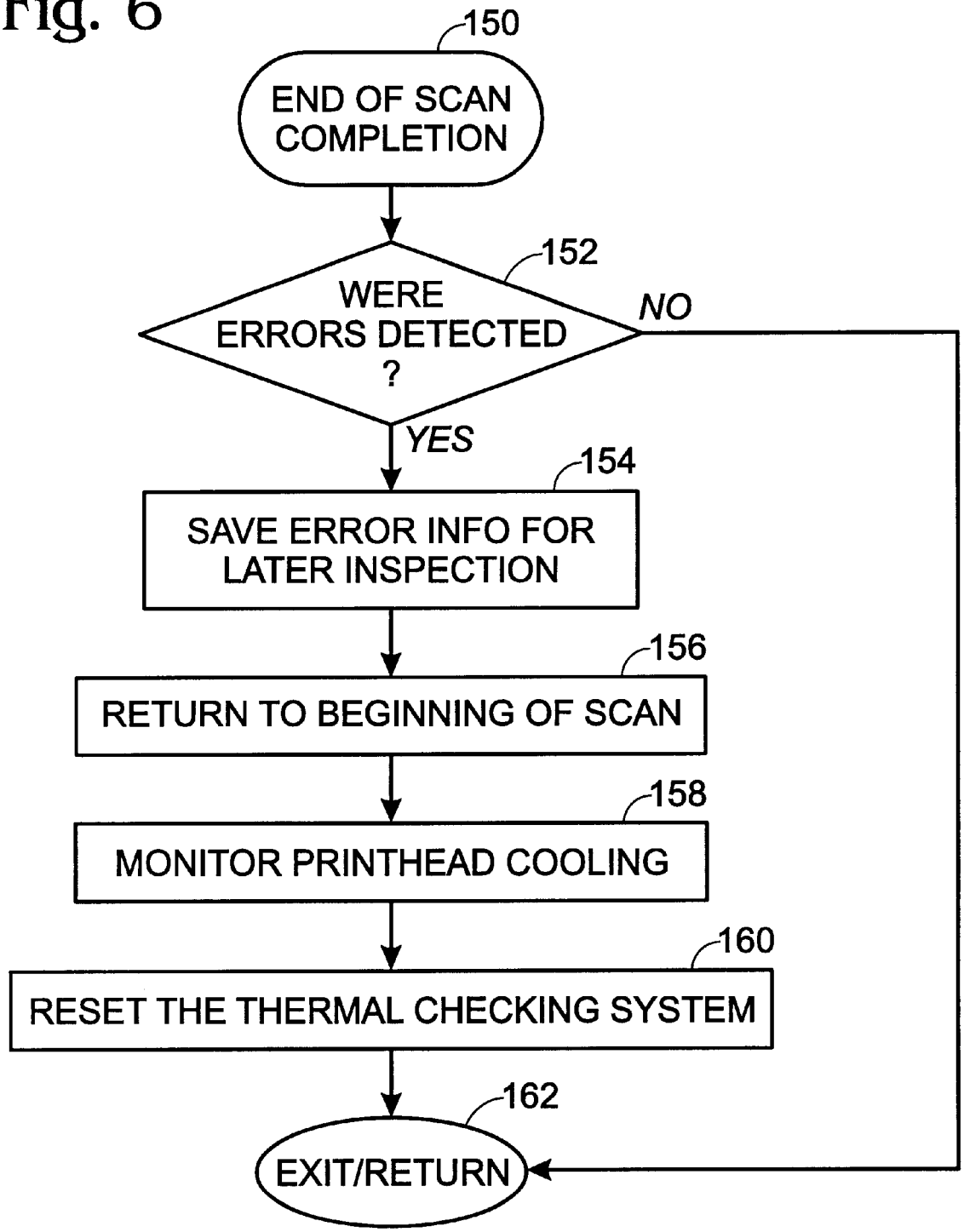

The flow charts of FIGS. 4–6 illustrate routines carried out in the printer controller 60 and its firmware modules prior to, during, and after completion of a single scan of the printhead across the media in accord with the dynamic temperature (thermal) control of the present invention.

FIG. 4 is a flowchart of a setup routine 100 for the thermal safety (overheat) checking aspects of the present invention. As shown at 102, the thermal checking is not enabled unless the scan to be performed is sufficiently long. For example, printing on a relatively small piece of photo media will not require in-scan thermal checking and, as at step 104, the thermal checking system is disabled and control is returned 112 to the main routine of the printer controller.

If the scan is sufficiently long to warrant setup and use of the thermal checking system, the temperature checkpoints are determined 106 at desired intervals (such as every 30 msec) and correlated to the carriage movement that is under the control of the mechanical control module 72.

The thermal checking data structures (such as the memory locations for storing the stopping points taken from the print data) are initialized 108, and the thermal checking system is enabled 110. Control is then returned 112 to the main printer controller routine.

FIG. 5 depicts the thermal checking routine 120 of the present invention, which is activated as a scan is commenced, deactivated once the scan is complete (or when printhead overheating is predicted) and executed during the scan. The enabled routine is called with each periodic interrupt and first 122 checks to determine whether the carriage (printhead) is at or has passed a thermal checkpoint. If not, control is returned 140 to main until the next interrupt.

As shown at 124, immediately after each checkpoint, the temperature control module 82 estimates whether, in the absence of cooling, the printhead will overheat. As noted, potential overheating will be determined when the two conditions discussed above are met; namely: (1) the slope of the printhead temperature profile indicates that the maximum operating temperature 88 will be exceed before the scan is complete; and (2) the running average temperature 50 of the printhead has exceeded a threshold temperature 90. If no overheating is estimated, the next checkpoint position is noted 126 for checking overheating 122 at the next iteration of this routine 120.

It is noteworthy here that in instances where more than one print cartridge is employed (hence more than one printhead) the thermal checking system will monitor the temperature of all of the printheads. Printing is halted in accordance with this invention whenever any one of the printheads overheats.

As described above, if the system estimates that overheating will occur during the scan unless the printhead is cooled, printing continues until reaching the nearest data boundary or stopping point 128. At that stopping point, the pixel generator halts the firing signals to the printhead resistors 130, directs to memory the unprinted data, and marks the stopping point 132 so that the printing may be resumed there after the printhead has cooled.

The fact that printing was stopped (i.e., an "error" occurred) is recorded 134 so that the printer controller can proceed accordingly (by, for example, preventing advancement of the print media feed until the scan is completed). If the printer employs more than one printhead, a flag is set to correspond to the overheating printhead 136 for later inspection by, for example, a monitoring process of the main printer controller routine.

Once overheating is detected, the periodic temperature checking for that scan is disabled 138 and control returned 140 to the calling routine.

The end of scan completion routine 150, shown in FIG. 6, determines 152 whether overheating errors were detected by the thermal checking system and, if so, saves that error information for later inspection.

The carriage is returned to the beginning of that scan 156 and the printhead temperature is monitored 158 until it drops to or below the above-described cooling temperature 94. Next the thermal checking system is reset 160 and control is returned 162 so that the printer controller can restart printing of the same scan as described above.

Although preferred and alternative embodiments of the present invention have been described, it will be appreciated by one of ordinary skill that the spirit and scope of the invention is not limited to those embodiments, but extend to the various modifications and equivalents as defined in the appended claims.

What is claimed is:

1. A method of controlling the temperature of an ink-jet printhead that is scanned across print media and is operable for firing ink drops in response to signals that correspond to a stream of firing data, the method comprising the steps of:

identifying boundaries within the firing data;

providing the printhead with signals for firing ink drops in accordance with the stream of firing data;

sensing the temperature of the printhead during a scan of the printhead across media;

estimating whether the printhead temperature will, unless cooled, exceed a maximum operating temperature during the scan; and stopping the printhead from firing ink drops in the event the printhead temperature is estimated to reach the maximum operating temperature during the scan, such stopping occurring at a location in the scan that corresponds to one of the identified boundaries.

2. The method of claim 1 wherein the stream of firing data corresponds to an entire scan of the printhead across the media and wherein the stopping step includes saving in memory a portion of the stream of firing data that comprises the firing data between the stopping location and the end of the scan.

3. The method of claim 2 including after the stopping step the steps of cooling the printhead and thereafter providing the printhead with signals for firing ink drops in accordance with the saved portion of the stream of firing data.

4. The method of claim 1 wherein the identifying step includes identifying as boundaries the locations between bytes of the firing data.

5. The method claim 1 including the step of determining a threshold temperature that is less than maximum operating temperature; and stopping the printhead from firing drops only if the printhead temperature exceeds the threshold temperature.

6. The method of claim 5 wherein the threshold temperature is determined as a function of the number of boundaries identified in the stream of firing data.

7. The method of claim 1 including the step of establishing a cooling temperature of the printhead and cooling the printhead to the cooling temperature after the stopping step.

8. The method of claim 1 wherein the sensing step includes sensing the temperature in the printhead a plurality of times during the scan and the estimating step includes calculating the running average of the sensed temperatures.

9. The method of claim 1 including the step of returning the printhead to the beginning of the scan after stopping the printhead from firing ink drops.

10. The method of claim 9 including the steps of:

allowing the printhead to cool; and then recommencing the step of providing the printhead with signals for firing ink drops.

11. The method of claim 10 wherein the recommencing step includes: providing the printhead with signals for firing ink drops beginning at the location in the scan where the firing of drops had been stopped.

12. A method of preventing overheating of an ink-jet printhead that is scanned across print media and that has a maximum operating temperature and that receives firing signals for firing ink drops onto the media, the firing signals corresponding to a stream of firing data, the method comprising the steps of:

monitoring the printhead temperature during the scan;

identifying in the stream of firing data boundaries at which the firing signals may be interrupted; and interrupting the firing signals during the scan in the event the printhead temperature is estimated to exceed the maximum operating temperature in the absence of such interruption.

13. A method of preventing overheating of an ink-jet printhead that is scanned across print media and that has a maximum operating temperature and that receives firing signals for firing ink drops onto the media, the firing signals corresponding to a stream of firing data, the method comprising the steps of:

monitoring the printhead temperature during the scan;

interrupting the firing signals during the scan in the event the printhead temperature is estimated to exceed the maximum operating temperature in the absence of such interruption, the interrupting step includes estimating the temperature of the printhead without use of thermal potential modeling of the thermal characteristics of the stream of firing data.

14. A method of preventing overheating of an ink-jet printhead that is scanned across print media and that has a maximum operating temperature and that receives firing signals for firing ink drops onto the media, the firing signals corresponding to a stream of firing data, the method comprising the steps of:

monitoring the printhead temperature during the scan; and interrupting the firing signals during the scan in the event the printhead temperature is estimated to exceed the maximum operating temperature in the absence of such interruption, wherein the monitoring step includes the step of determining a threshold temperature that the printhead temperature must exceed before carrying out the interrupting step.

15. The method of claim 14 including the step of identifying boundaries in the stream of firing data, at which boundaries the firing signals may be interrupted and wherein the threshold temperature is determined as a function of the number of boundaries identified in the stream of firing data.

16. A method of preventing overheating of an ink-jet printhead that is scanned across print media and that has a maximum operating temperature and that receives firing signals for firing ink drops onto the media, the firing signals corresponding to a stream of firing data, the method comprising the steps of:

monitoring the printhead temperature during the scan; and interrupting the firing signals during the scan in the event the printhead temperature is estimated to exceed the maximum operating temperature in the absence of such interruption, wherein the monitoring step includes sampling the printhead temperature several times as the scan progresses and calculating a running average of that temperature and extrapolating the running average.

17. A system for preventing overheating of an ink-jet printhead that receives control signals for firing ink drops and that has a maximum operating temperature, comprising:

sensing means for sensing the printhead temperature as the printhead is scanned across print media;

estimation means for estimating whether the maximum operating temperature will be exceeded during the scan in the absence of steps to cool the printhead; and cooling means responsive to the estimation means for stopping the printhead from firing ink drops during a scan in the event the estimation means estimates that the printhead maximum operating temperature will be exceeded during the scan, and for noting the location where the printhead firing may be stopped by identifying in the firing signals boundaries at which the printhead firing may be stopped.

18. The system of claim 17 wherein the cooling means includes memory means for saving data corresponding to the firing signals that are not fired as a result of stopping the printhead from firing drops.

19. The method of claim 17 including recommence means for recommencing the scan after the printhead is cooled to a selected temperature and for controlling the printhead to recommence firing ink drops at the location in the scan where such firing had been stopped by the cooling means.

* * * * *